US010463941B1

(12) United States Patent
Isbell

(10) Patent No.: US 10,463,941 B1
(45) Date of Patent: Nov. 5, 2019

(54) GOLF SWING APPARATUS AND RELATED GOLF GAME

(71) Applicant: Richard Bryan Isbell, Citrus Heights, CA (US)

(72) Inventor: Richard Bryan Isbell, Citrus Heights, CA (US)

( * ) Notice: Subject to any disclaimer, the term of this patent is extended or adjusted under 35 U.S.C. 154(b) by 0 days.

(21) Appl. No.: 16/119,203

(22) Filed: Aug. 31, 2018

Related U.S. Application Data

(60) Provisional application No. 62/557,476, filed on Sep. 12, 2017.

(51) Int. Cl.
*A63B 69/36* (2006.01)
*A63B 55/10* (2006.01)
*A63B 102/32* (2015.01)

(52) U.S. Cl.
CPC ..... *A63B 69/365* (2013.01); *A63B 55/10* (2013.01); *A63B 2102/32* (2015.10); *A63B 2225/093* (2013.01)

(58) Field of Classification Search
CPC ..... A63B 69/36; A63B 69/38
See application file for complete search history.

(56) References Cited

U.S. PATENT DOCUMENTS 2,328,408 A * 8/1943 Beil ..... A63B 69/365 473/229
3,132,865 A * 5/1964 Parker ..... A63B 69/3676 248/166
3,953,035 A * 4/1976 Beckisk ..... A63B 69/3676 473/229
4,047,605 A * 9/1977 Rosenvold ..... A63B 69/365 194/291
4,718,674 A * 1/1988 Henry ..... A63B 69/3623 473/218
5,125,844 A * 6/1992 Grant ..... A63B 69/3676 434/252
5,657,828 A * 8/1997 Nagamachi ..... B60L 50/52 180/19.3
6,551,197 B1 * 4/2003 Travo ..... A63B 69/3676 473/258

(Continued)

FOREIGN PATENT DOCUMENTS

JP 2017000323 5/2017
KR 1020100010523 8/2012
WO 2012114091 8/2012

*Primary Examiner* — Eugene L Kim
*Assistant Examiner* — Christopher Glenn
(74) *Attorney, Agent, or Firm* — John P. Costello; Costello Law Corp.

(57) ABSTRACT

A golf swing assistance apparatus comprises a cart body having a gear assembly, a height adjustable body rest pad, a pair of handle means adaptable to actuate the gear assembly, a safety shroud, a carrier, a drive shaft and a balancing cart leg connected to a stabilizing foot. The gear assembly includes a main ring gear operably coupled to a drive shaft gear by means of a pawl. The safety shroud ensures safety of a player and the carrier holds at least one golf club. The balancing cart leg adjusts the height of the apparatus. When the player actuates the gear assembly by pressing the handle, the drive shaft creates a direct drive mechanism that rotates the carrier and adjusts the at least one golf club in a perfect arc to hit a golf ball by providing a swing motion to the golf club.

35 Claims, 10 Drawing Sheets

(56) References Cited

U.S. PATENT DOCUMENTS

| | | | | |
|---|---|---|---|---|
| 7,585,228 | B2 * | 9/2009 | McFarlin | A63B 21/157 473/229 |
| 7,883,429 | B1 * | 2/2011 | Chen | A63B 69/365 473/229 |
| 8,298,094 | B1 * | 10/2012 | Chen | A63B 69/3644 473/229 |
| 8,591,349 | B1 * | 11/2013 | Jones | A63B 69/3644 473/229 |
| 8,715,098 | B2 * | 5/2014 | Napolitano | A63B 69/3644 473/257 |
| 2006/0079341 | A1 * | 4/2006 | Mansour | A63B 69/3608 473/219 |
| 2011/0067507 | A1 * | 3/2011 | Miyamae | A63B 60/02 73/865.9 |

* cited by examiner

GOLF SWING APPARATUS AND RELATED GOLF GAME

RELATED APPLICATIONS

This application claims the benefit of U.S. Provisional Ser. No. 62/557,476, filed on Sep. 12, 2017.

BACKGROUND OF THE DISCLOSURE

Technical Field of the Disclosure

The present embodiment relates in general to devices and methods for playing the game of golf, and more specifically, to an apparatus which imparts a golf swing to a golf club, thus rendering a player to the task of lining up a golf shot, but not actually having to swing the club.

Description of the Related Art

A proper golf swing is necessary to competently play the game of golf. It is the proper swing which allows a player to lift the ball into the air and to stay on the fairway portion of a golf course, rather than slice it into the rough. In fact, many golf course "pros" insist that their students be able to land on the fairway consistently, before they allow them to go out and play their first full game of golf. Improper golf swings lead to ground balls and lost balls, resulting in slow play, which can affect others playing on a golf course.

It is not uncommon for individuals to fail to master a consistently correct golf swing. Despite much practice, some players instead consistently slice, shank or "skull" balls, leading to long searches in the rough, or else the damaging or loss of balls altogether. Often, after numerous frustrating rounds, these failed players often quit the game of golf entirely.

The reason the golf swing is such a critical failure point in the game of golf is because too much can go wrong from the start of a swing to the end thereof, when the club finally contacts the ball. In the arc of a swing, the club can become misaligned by the slightest error in body position, balance or movement, leading to bad shots occurring. Practice can overcome these deficiencies, but even with practice, some players never master a proper swing. Therefore, if a mechanical substitute can provide the element of a competent golf swing, then all that is left for the player to do is to line up the shot by making sure that the club face will properly contact the ball to achieve a successful shot.

Mechanical devices for providing a competent golf swing have been devised in the past. Korean Application No. 10201000010523 published to Okesaku on Aug. 20, 2012 describes a golf swing training apparatus which uses a counter-weight swinging in an arc to help a player improve his golf swing. Japanese Application Publication No. 2017-000323 published on May 1, 2017 describes a golf swing device which attaches a club and is wound up to retain elastic energy. When a shot is lined up, the player can release the device and the elastic energy is released, swinging the club in an arc; this device is retained on a tri-pod, which would be difficult to set up and maneuver for each shot if used on a golf course. WIPO Application No. WO 2012/114091 published to Vickers on Aug. 30, 2012 describes a golf swing device with a tri-pod mount and a counter weight. A club is attached to the device to simulate a golf swing. United States Pat. Application Publication No. 2011/0067507 published to Miyamae on Mar. 24, 2011 describes a golf club testing apparatus which uses geared mechanisms to swing a club on several axes. This device is stationary and is not portable.

A mechanical golf-swing apparatus which is made easily portable for a player could literally bring back many players to the game of golf, who had previously quit the game, due to their inability to master a proper golf swing or due to acquiring a physical limitation as to rotating their body in a manner consistent with a normal golf swing. The present invention has devised an apparatus which is easily transported around a golf course and which provides a competent golf swing for properly contacting a golf ball nearly every time without rotating the players body. The inventive apparatus does still require that a golfer provide all inputs to the apparatus for lining up and executing a golf shot, including lifting the ball into the air and applying the necessary left or right spin in order to add an intentional "draw" or "fade" aspect to the ball's flight, so a level of skill can be acquired and maintained, which makes mastering a golf game using the apparatus a challenging endeavor.

Therefore, there is a need for an apparatus for playing a game of golf which provides a competent and consistent golf swing nearly every time. Such an apparatus would provide a competent golf swing to a golf club, so that a player is not tasked with having to manually provide the golf swing aspect of a golf game. Such a golf swing apparatus would allow a player to learn a level of skill in providing kinesthetic inputs for lining up a golf shot and adjusting the ball's flight path. Such a golf swing apparatus would allow the game of golf to be played by players who have had difficulty in learning a consistent and competent golf swing, players who are rank beginners and have never played a round of standard golf and some players who have lost the physical ability to swing a golf club in the traditional manner. Such a needed apparatus would create a new game for playing golf wherein the golf swing apparatus is used to provide a competent golf swing, rather than relying on the players themselves to supply the golf swing component of the game. The present invention overcomes the prior art shortcomings by accomplishing these objectives.

SUMMARY OF THE DISCLOSURE

To minimize the limitations found in the prior art, and to minimize other limitations that will be apparent upon the reading of the specification, the preferred embodiment of the present invention provides an apparatus for playing a game of golf which provides a competent and consistent golf swing nearly every time. The apparatus removes the requirement of a proper golf swing provided by a player. Instead, the player's role is to maneuver the apparatus and apply the desired settings so that the golf club is properly aligned for making a shot with the desired flight path to the next hole. When the player has properly set up the shot, he manually actuates the apparatus, thus swinging the club in an arc, bringing the club head into contact with the ball.

In one embodiment, the apparatus takes the form of a cart which has a handle for grasping and towing around a golf course; very similar to how players presently use a two or three-wheeled cart to tow their golf bag and clubs around a course. The cart also has a height-adjustable body rest pad on top of the cart which allows a player to rest his upper body upon, and along with handles protruding from the side of the cart, together provide the means for properly aligning a golf shot. In real terms, the player using the apparatus uses his body or more precisely kinesthetic inputs to adjust the cart so as to line up the club head with the ball.

The apparatus contains a direct-drive mechanism for moving a golf club in an arc for hitting a golf ball. The direct-drive mechanism imparts significant rotational energy to the club, causing it to swing in a perfect arc, consistently, every time. In the preferred embodiment, the mechanism is a mechanical gear array which the player actuates using a pair of opposing handles movably attached at the sides of the apparatus. The handles are attached to slide assemblies and the handles can move up and down with the slide assemblies. Opposite the handles are rack gears attached to the slide assemblies, the rack gears engaging with a main ring gear which is mounted on a bearing located on a drive shaft, which engages a second, smaller ring gear (which is mounted directly to the drive shaft), by means of at least one pawl attached to the main ring gear. The apparatus has a single balancing leg protruding from its bottom which is length adjustable, attached to a spiked foot with a concave bottom for stability on ground and/or sand, attached by so means of a ball joint for adjustment of the apparatus angle to the ground. If the apparatus takes the form of a cart, the balancing leg allows the cart to be lifted off of its wheels and balanced in conjunction with the player's body providing kinesthetic inputs.

The player addresses the ball in the same manner that a golfer does. With the club head in the 6 o'clock position, the cart is rolled up to the ball and then rocked forward onto the balancing leg, bringing the wheels off of the ground so that all of the weight is supported on a single point, the balancing leg and foot. Noticing the relative position of the club head to the ball, the player will adjust as needed for proper contact position and the correct shaft angle to the ground. Players will get better and quicker at this as they gain experience. Once the player has reached his desired position, he leans forward and places his lower rib cage on the body rest pad and applies approx. 50% of his body weight down, through the cart body to the balancing leg, anchoring it in position. Both of the player's feet and the balancing leg form a tripod base for stability. At this point the club's position will be stable enough to move the hand grips up and down, therefore, swinging the club in an arc motion in both clockwise and counterclockwise directions, just as a golfer would draw the club back for a backswing then bring it back up to the ball, without hitting it, as a practice/alignment swing. The final back swing can be any amount up to approx. 350 degrees to the 5 o'clock position (right-handed swing) before immediately pushing and pulling evenly with both hands on the handles. The handles are moved as forcefully as necessary for the desired distance, while maintaining the club body's position (again, a learned skill) to apply up to maximum power into the shot, taking care not to disturb the position or angle of the club body.

An object of the invention is to provide a golf swing apparatus which provides a competent golf swing to a golf club, so that a player is not tasked with having to manually provide the golf swing aspect of a golf game.

Another object of the invention is to provide a golf swing apparatus which still requires a player to learn a level of skill in providing kinesthetic inputs for lining up a golf shot and adjusting the ball's flight path.

A further object of the invention is to provide a golf swing apparatus which allows the game of golf to be played by players who have had difficulty learning a consistent and competent golf swing, players who are rank beginners and have never played a round of standard golf and some players who have lost or never had the physical ability to swing a golf club in the traditional manner.

Another object of the invention is to create a new game for playing golf wherein the golf swing apparatus is used to provide a competent golf swing, rather than relying on the players themselves to supply the golf swing component of the game.

These and other advantages and features of the present invention are described with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in u the interest of clarity and conciseness.

DETAILED DESCRIPTION OF THE DRAWINGS

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
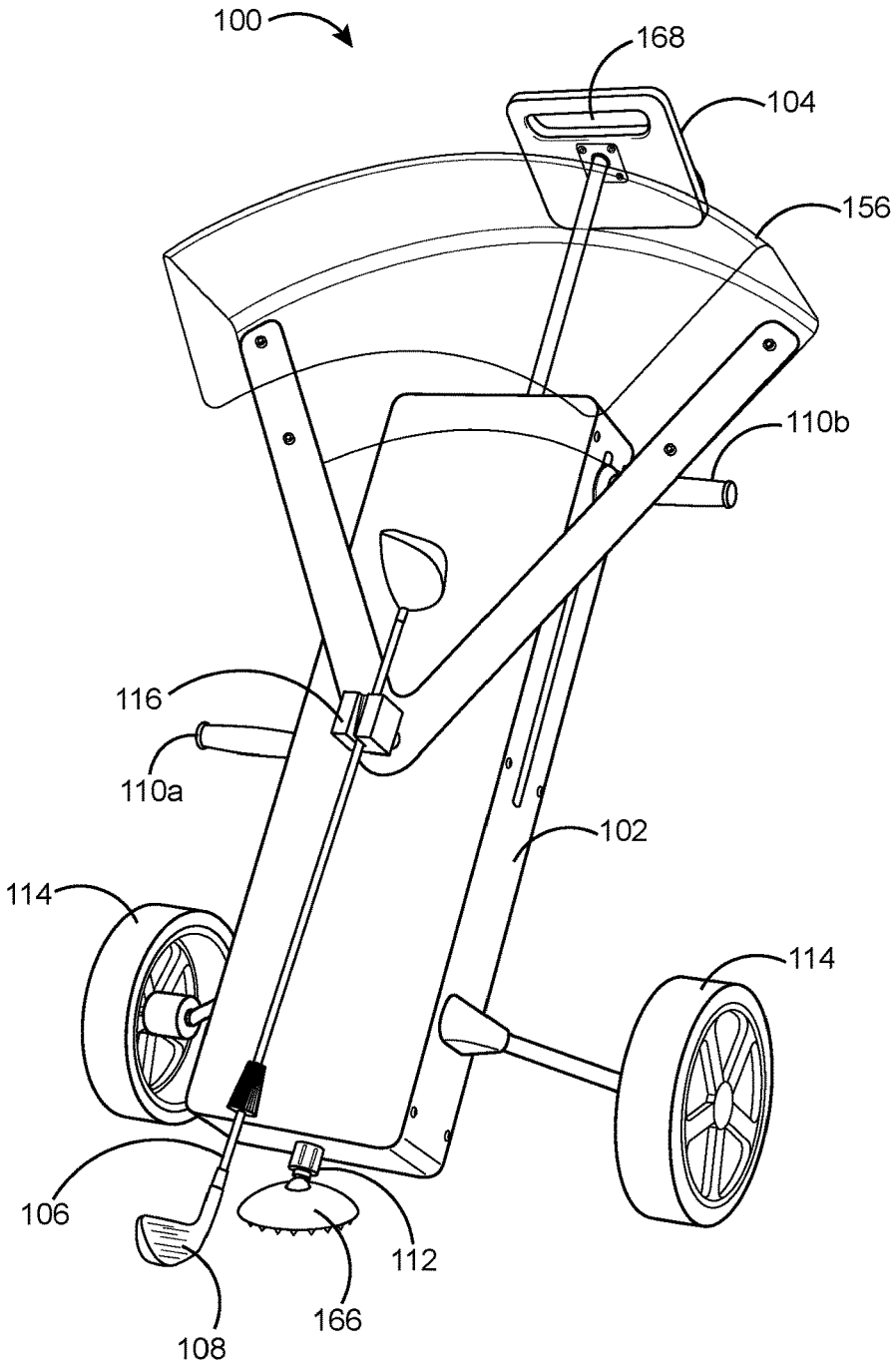
FIG. 1 is a front perspective view of a golf swing apparatus in accordance with the preferred embodiment of the present invention.

Turning first to FIG. 1, a front perspective view of a golf swing apparatus in accordance with the preferred embodiment of the present invention is illustrated. The golf swing apparatus 100 is portable, so that it can be towed around a golf course in much the same manner as present golfers tow two or three-wheeled golf carts loaded with their golf bags and related items. To these ends the golf swing apparatus 100 is a cart body 102, having a pair of cart wheels 114. A balancing cart leg 112 extends from the bottom surface of the body of the golf swing apparatus 100 and connects to a stabilizing foot 166 by means of a ball joint. The balancing leg 112 being length-adjustable, thus allowing the amount of extension relative to the bottom surface of the apparatus 100 to be determined by a player 160 (shown in FIG. 7). The stabilizing foot 166 is round, concave on bottom and spiked around the bottom of the rim. The stabilizing foot 166 is concave to set up firmly in sand. It is mounted via the ball joint for adjustment to the angle of the cart body 102. A height-adjustable body rest pad 104 is made possible by a male support member insertable into a larger diameter female support channel member, locked in place by a compression collar. A slot 168 in the body of rest pad 104 is the handle for towing. A golf club 106 having at least one golf head 108 is mounted in a carrier 116 which is rotatably attached to a drive shaft 128 (shown in FIG. 2) of the apparatus 100. The player grasps both handles, a left handle means 110*a* and a right handle means 110*b* to rotate a gear assembly 142 (shown in FIG. 2) located inside of the cart body 102. The gear assembly being rotatably connected to the carrier 116 that rotates and swings the golf club 106 in a perfect arc. A safety shroud 156 surrounding the golf club 106 is dome shaped to accommodate the arc traveled by the golf club 106 when it is in motion. While optional, the safety shroud 156 insures that the player will not be struck by the golf club 106 as it swings in an are. If the safety shroud 156 is employed, it is preferably made from clear plexiglass to insure that the player 160 (shown in FIG. 7) can still look down and line up the club head 108 during game play.

Figure 2:
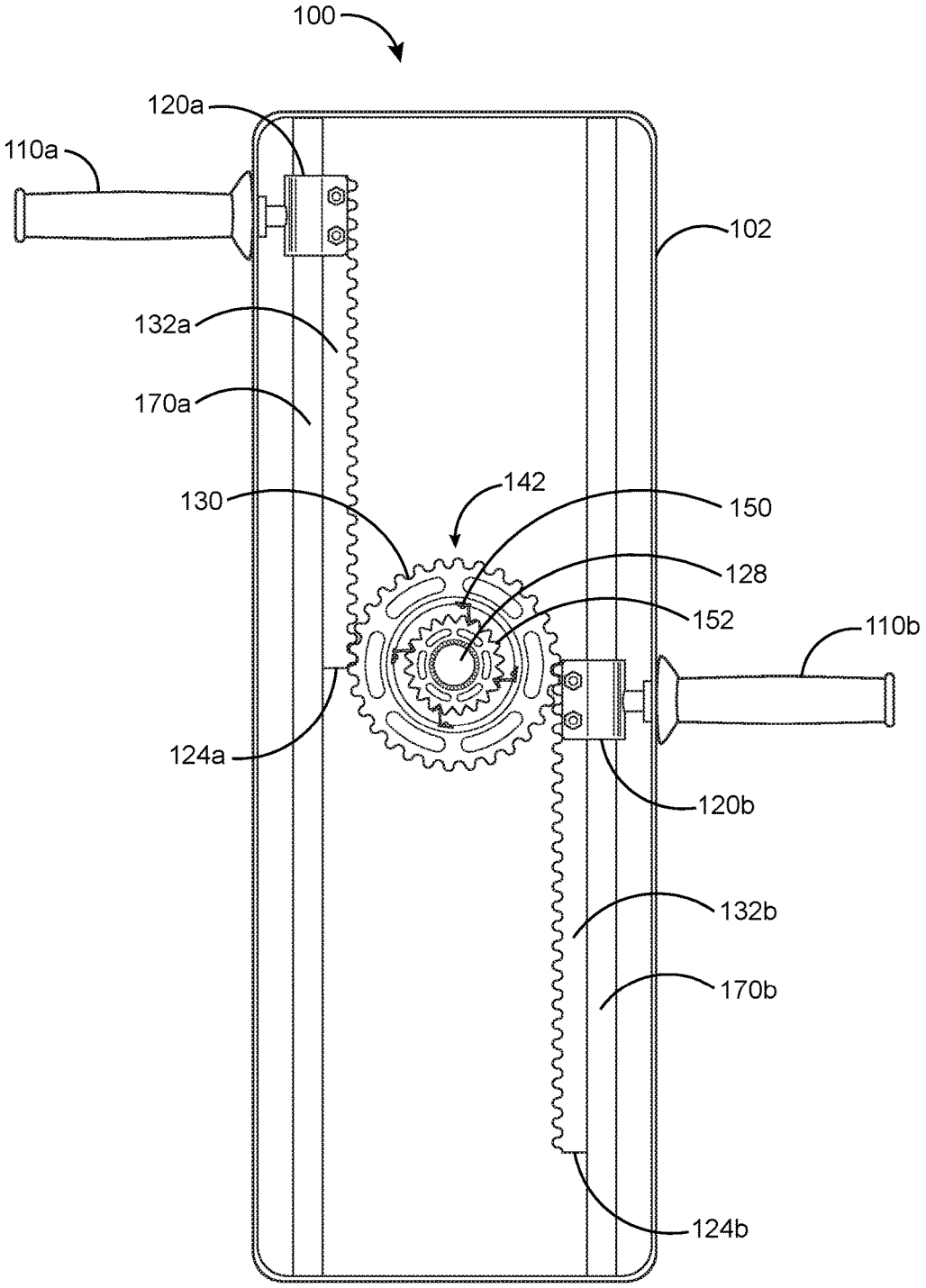
FIG. 2 is a schematic cross-sectional rear view of the golf swing apparatus shown in FIG. 1 in accordance with the preferred embodiment of the present invention.

FIG. 2 is a schematic cross-sectional rear view of the golf swing apparatus 100 (shown in FIG. 1) according to the preferred embodiment of the present invention. This view shows the gear assembly 142. The gear assembly 142 is a mechanical gear array which keeps interaction with a pair of slide assemblies 124*a* and 124*b*. The gear assembly 142 is actuated by the player 160 (shown in FIG. 7) using the left handle means 110*a* and the right handle means 110*b* movably attached at the sides of the cart body 102. The handles 110*a* and 110*b* are attached to the slide assemblies 124*a* and 124*b* at each side respectively. The handles 110*a* and 110*b* can move up and down with the slide assemblies 124*a* and 124*b*. Opposite the handles 110*a* and 110*b* are rack gears 132*a* and 132*b*, which are fixed to the slide assemblies 124*a* and 124*b*. The rack gears 132*a* and 132*b* engages with a main ring gear 130 mounted on a drive shaft 128. The main ring gear 130 engages at least one pawl 150. It's a flexible pawl. A removable bolt (Not Shown) secures the at least one pawl 150 to the main gear 130. The at least one pawl 150 is strong enough to facilitate a back swing. The back swing is achieved by the at least one pawl 150. Removing the bolt and reversing the pawl direction is the method for switching from right to left handed. The drive shaft gear 152 is fixed to the drive shaft 128. The side of the cart body 102 includes two slots (Not Shown) imparted therein, these slots accommodating so the handle brackets 120*a* and 120*b* which attaches to the slide assemblies 124*a* and 124*b* on the interior side of the cart body 102. The handles 110*a* and 110*b* are attached to the handle brackets 120*a* and 120*b*, the handle being one of two handles arranged in opposite relation as shown in FIG. 2. The slide assemblies 124*a* and 124*b* consist of two handle brackets 120*a* and 120*b* containing roller bearings (not shown), one mounted at each end of the rack gears 132*a* and 132*b* which slide along tubular support columns 170*a* and 170*b*. The player 160 (shown in FIG. 7) grasps both handles 110*a* and 110*b* to rotate the gear assembly 142 located inside of the cart body 102, the gear assembly being rotatably connected to the carrier 116 (shown in FIG. 1) which rotates and swings the golf club 106 (shown in FIG. 1) in a perfect arc.

Still referring to FIG. 2, the at least one pawl 150 is flexible and is secured by bolts (Not Shown). The at least one pawl 150 is an angled tension spring of significant strength mounted to the interior of a circular extrusion on the main gear 142 (which surrounds the drive shaft gear 152) by at least one removable bolt (Not Shown) per pawl 150. By increasing the number of pawls 150, the strength of the swing, backswing and the braking affect after the swing will increase. The angle at which the pawl 150 makes contact with the tooth profile of the drive shaft gear 152 will determine which rotational direction will be fixed (swing) and which rotational direction will ratchet (swing run out) and pull (backswing). The cart body 102 needs to be 2× the length of the slide assembly 124 in order to utilize the full throw of the slide. The length of the rack gears 132 is equal to or greater than the circumference of the main gear 130 for one full rotation of the club drive shaft 128 and the golf club 106 (shown in FIG. 5) per linear handle stroke.

Figure 3:
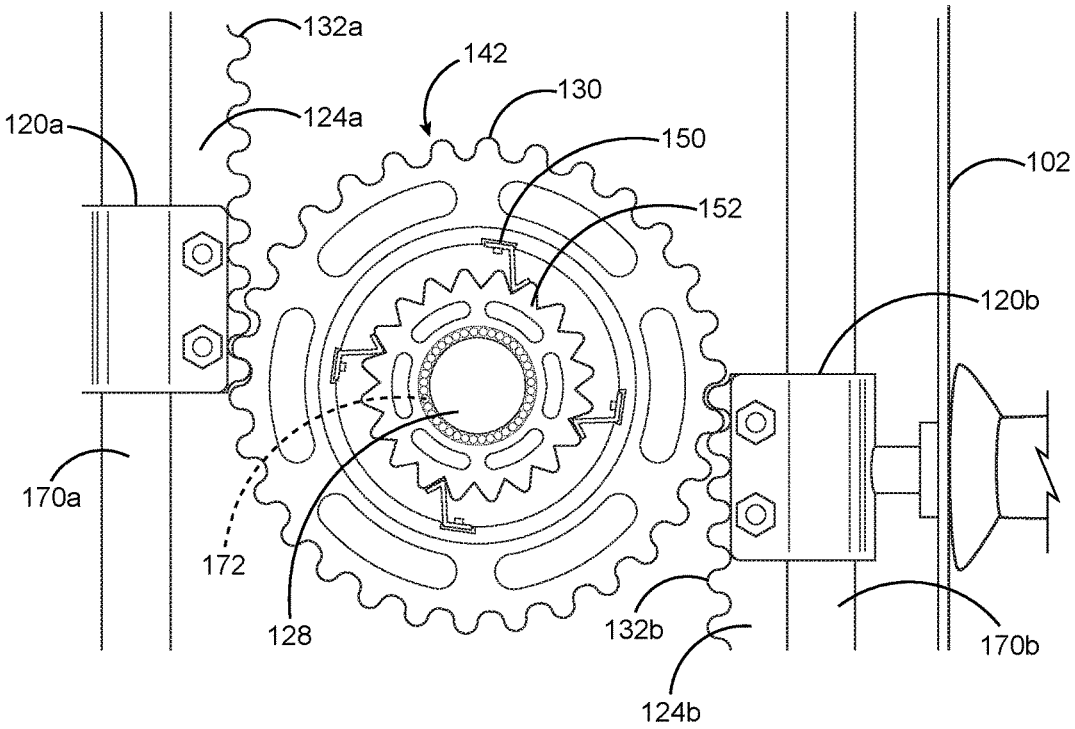
FIG. 3 is an inner rear-view of the present golf swing apparatus showing the gear assembly in detail.

FIG. 3 is an inner rear-view of the present golf swing apparatus showing the gear assembly in detail. The gear assembly 142 is a mechanical gear array which keeps interaction with the slide assemblies 124*a* and 124*b*. The handles 110*a* and 110*b* (shown in FIG. 2) are attached to the slide assemblies 124*a* and 124*b* and the handles 110*a* and 110*b* can move up and down with the slide assemblies 124*a* and 124*b*. The gear assembly 142 is actuated by the player 160 (shown in FIG. 7) using the handle means 110*a* and 110*b* movably attached at the sides of the cart body 102. The slide assemblies 124*a* and 124*b* consist of two brackets 120*a* and 120*b* containing roller bearings (Not Shown), one mounted at each end of the rack gears 132*a* and 132*b* and which slide along the tubular support columns 170*a* and 170*b*. The rack gears 132*a* and 132*b* are fixed to the slide assemblies 124*a* and 124*b*, the rack gears 132*a* and 132*b* engaging with the main ring gear 130 mounted on the drive shaft 128. This view illustrates the interaction of the main ring gear 130 with the at least one pawl 150. The main ring gear 130 engages the at least one pawl 150 utilizing the at least one bolt (Not Shown). The at least one pawl 150 is strong enough to facilitate the back swing. The back swing is achieved by the at least one pawl 150 along with the at least one bolt (Not Shown). The main ring gear 130 is operably engaged to the drive shaft gear 152 and is secured in place by a bearing means 172 around the drive shaft 128, allowing the main ring gear 130 to rotate independently of the drive shaft 128. The drive shaft gear 152 is fixed to the drive shaft 128. The main ring gear 130 engages one or more pawls 150 attached to the main ring gear 130. The at least one pawl 150 is engaged in the longitudinal slots in the extrusion of the main ring gear 130. This typical mechanism holds the main ring gear 130 from moving axially along the axis of the driveshaft 128 by mechanically mounting the main ring gear 130 on bearings attached to the drive shaft 128. The at least one pawl 150 can be flipped over or selected alternatively to change direction of swing to accommodate both left-handed and right-handed players.

Figure 4:
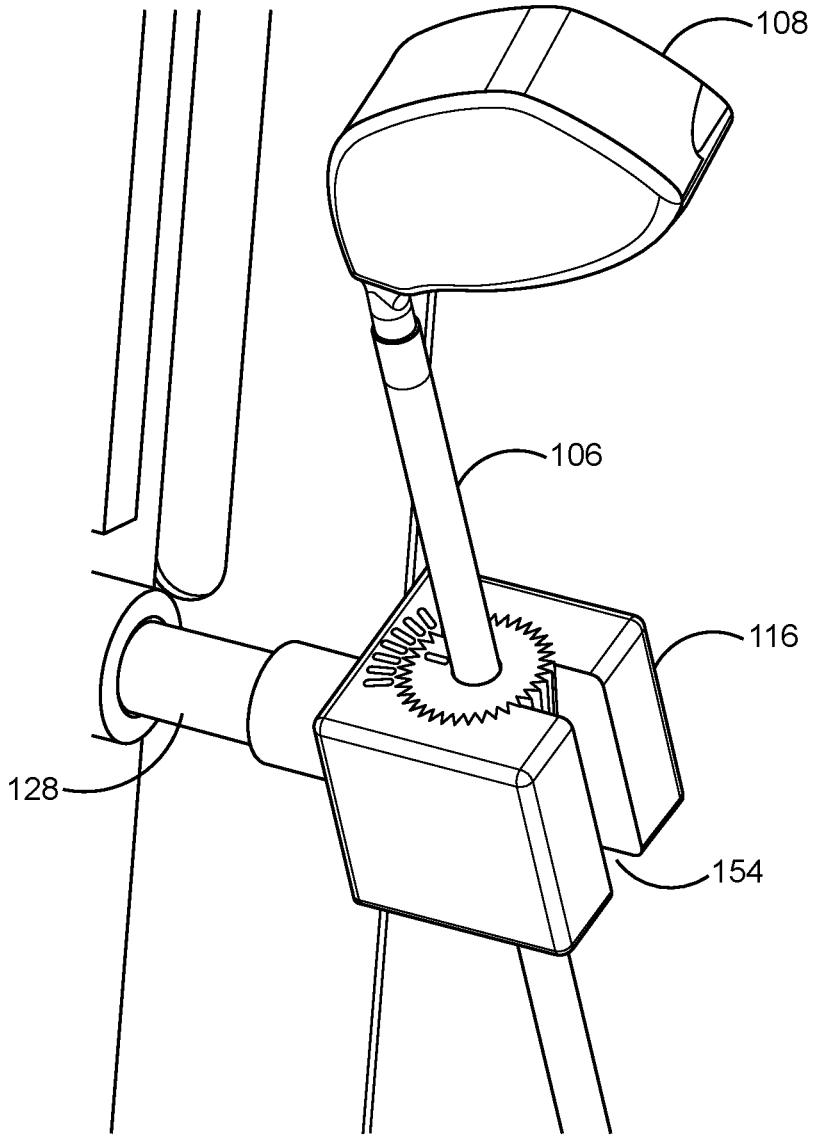
FIG. 4 is a perspective view that shows the carrier assembly of the golf swing apparatus shown in FIG. 1 in accordance with the preferred embodiment of the present invention.

FIG. 4 is a perspective view that shows the carrier assembly of the golf swing apparatus shown in FIG. 1. The golf club 106 having the at least one golf head 108 is mounted in the carrier 116 which is rotatably attached to the drive shaft 128 of the apparatus. The carrier 116 encases a female cone-type connector which narrows in the direction of the club head 108 that is selected for use. The golf club 106 contains at least one male cone-type connector 144 (shown in FIG. 5) which narrows in the direction of the club head 108 that is selected for use. The carrier 116 has an opening at its front to facilitate golf club 106 changes. The male cone-type connector 144 contains a reference mark on top to indicate a neutral open/close position of the club head 108. The carrier 116 contains a series of marks, each mark indicating 10 degrees of open/close rotation of the club head 108.

Figure 5:
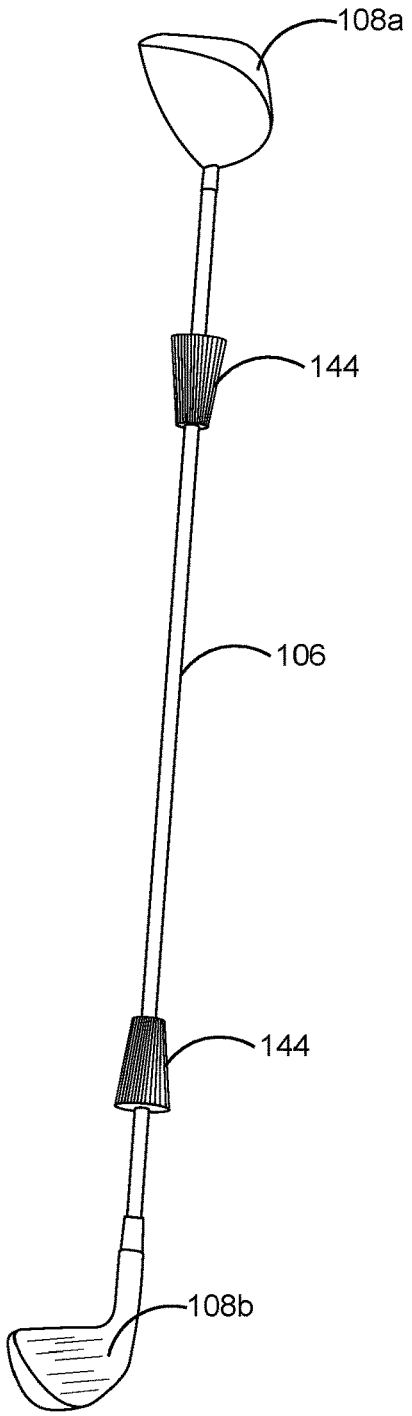
FIG. 5 illustrates a golf club as a dual-headed embodiment of the present invention.

FIG. 5 illustrates the golf club 106 as a dual-headed embodiment of the present invention. If a dual-headed club set, the first golf head 108*a* and the second golf head 108*b* is used, it is best if the two clubs are close in application. Conceivably, two sets of dual headed clubs (one set for the long game; one set for the short game) plus a putter and a driver, would be enough for most players to play an entire game of golf and multiple dual-headed golf clubs 106, removably attached to the rear of the apparatus 100 by clips (Not Shown) would allow for up to a full range of club heads 108 to be carried. The golf club 106 has a shaft length of about 12 inches to 20 inches. The golf club 106 and cone-type connection means (male component) 144 are illustrated in this view. Although centrifugal force holds the club in the carrier 116 (shown in FIG. 4) there should still be a hold-down mechanism of some kind for safety. The golf club 106 is enabled with different heads (108 and 108*b*) on each end and the heads can be interchanged by engaging the appropriate male cone-type connector. For example, if the dual-headed golf club 106 contains golf heads (108*a* and 108*b*) as a nine-iron and a pitching wedge, it would allow a golfer to choose between two close high-loft clubs; whereas a three-iron and a five-iron would allow the player two good choices for long distance on the fairway.

Figure 6:
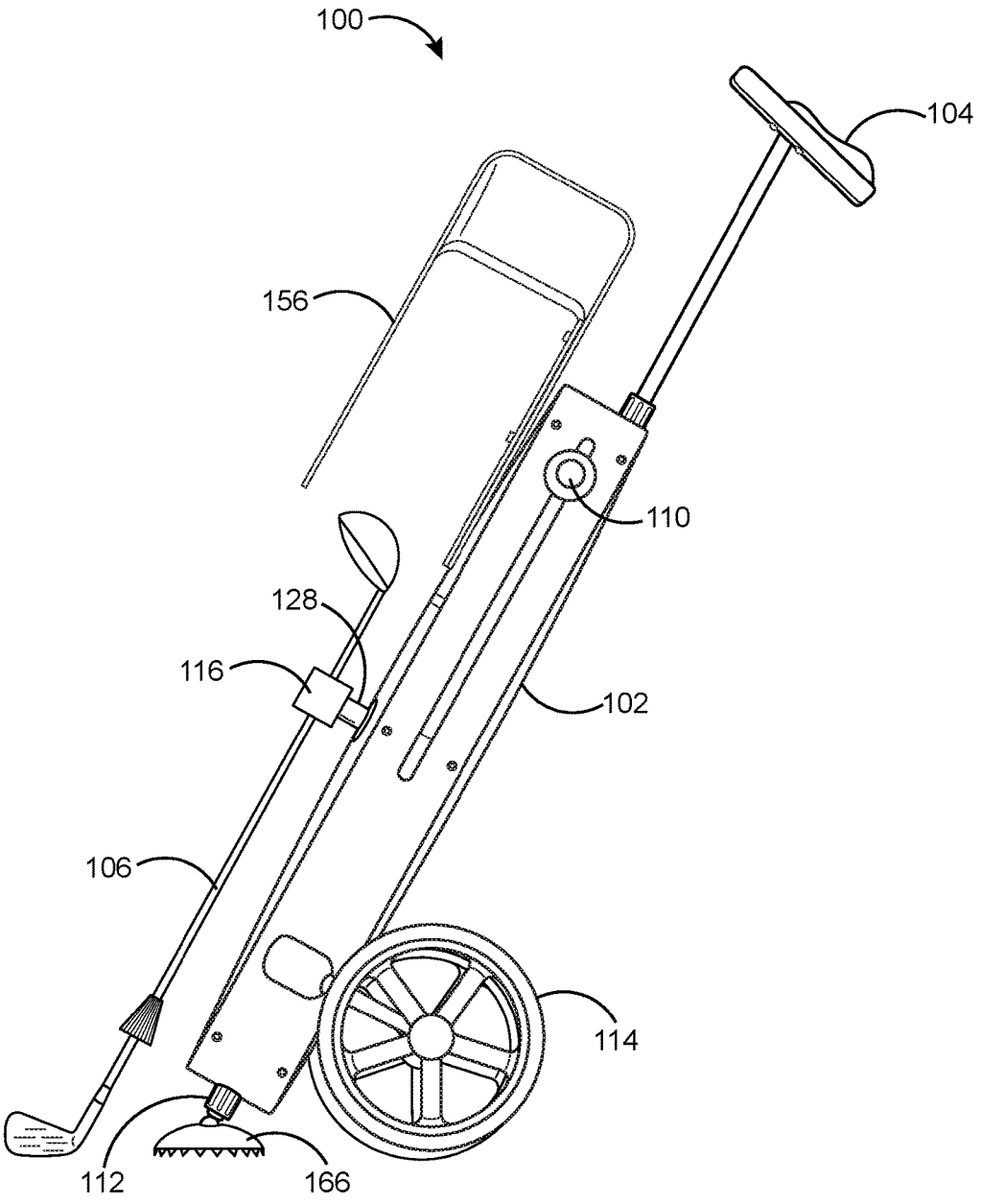
FIG. 6 is a side view of the embodiment presented in FIG. 1, showing the golf swing apparatus.

FIG. 6 represents a side view of the embodiment presented in FIG. 1, showing the apparatus 100 positioned on the balancing leg 112 and the stabilizing foot 166 as it might appear being readied for a golf shot. This view shows how the wheels 114 are attached extending outward and rearward from the side of the cart body 102 so that the golf swing apparatus 100 can alternately be placed in a towing position and then in a as position standing on the balancing leg 112 and the stabilizing foot 166. The height level of the balancing leg 112 is adjustable, primarily for adaptation to the varying ground slopes of a typical course. This view also shows the height-adjustable body rest pad 104, primarily set to the player's height at the beginning of the round. The height adjustment of the body rest pad 104 is made possible by the male support member insertable into the larger diameter female support channel member and locked in place by a tightening collar. The golf club 106 is mounted in the carrier 116 which is rotatably attached to the drive shaft 128 of the apparatus 100. The apparatus 100 takes the form of a cart which has a handle integrated into the body rest pad 104 for grasping and towing around a golf course; very similar to how players presently use a two or three-wheeled cart to tow their golf bag and clubs around a course. The height-adjustable body rest pad 104 on top of the cart body 102 allows the player 160 (shown in FIG. 7) to rest his upper body upon, and along with handles 110 protruding from the sides of the cart, together provide the means for properly setting up a golf shot. The safety shroud 156 surrounding the golf club 106 is dome-shaped to accommodate the arc traveled by the club when it is in motion. The safety shroud 156 insures that the player's upper body will not be struck by the club as it swings in an arc. The safety shroud 156 is preferably made from clear plexiglass to ensure that the player can still look down and line up the club head 108 during game play.

Figure 7:
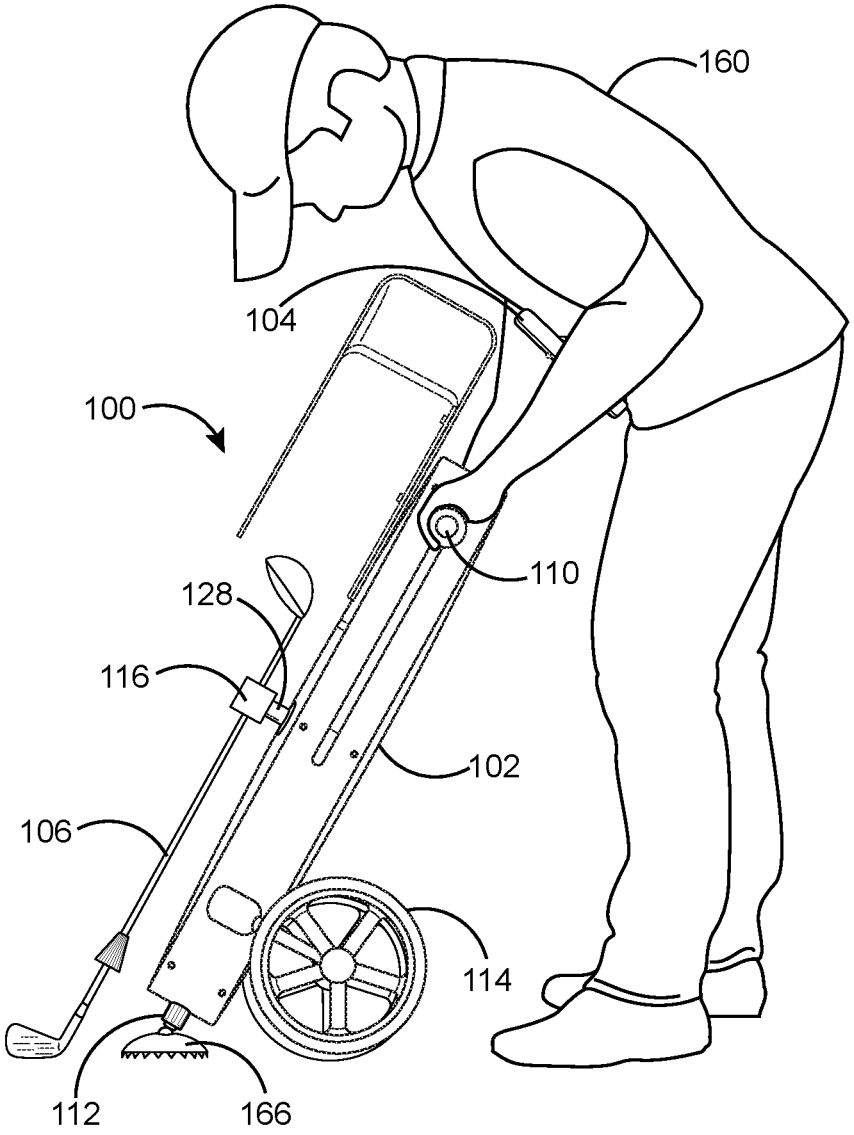
FIG. 7 illustrates a side view of the golf swing apparatus in use by a player.

FIG. 7 illustrates a side view of the golf swing apparatus in use. The player 160 grasps and moves the handles 110 to rotate the gear assembly 142 (shown in FIG. 2) located inside of the cart body 102, the gear assembly being rotatably connected to the carrier 116 which rotates and swings the golf club 106 in a perfect arc. The apparatus 100 is positioned on the balancing leg 112 and the stabilizing foot 166 as it might appear being readied for a golf shot. The height level of the balancing leg 112 is adjustable, primarily for adaptation to the varying ground slopes of a typical course. The height adjustment of the body rest pad 104 is made possible by the male support member insertable into a larger diameter female support channel member and locked in place by a tightening collar. The apparatus takes the form of a cart which has the handle integrated into the body rest pad 104 for grasping and towing around a golf course; very similar to how players presently use a two or three-wheeled cart to tow their golf bag and clubs around a course. The height-adjustable body rest pad 104 on top of the cart 102 which allows the player 160 to rest his upper body upon, and along with the handles 110 protruding from the sides of the cart, together provide the means for properly setting up a golf shot.

The player addresses the ball in the same manner that a golfer does. With the club head (108*a* and 108*b*) in the 6 o'clock position, the cart body 102 is rolled up and positioned behind the ball. If an alternate open/close position of the club head 108 is desired, then it is set at this time using the reference marks located on the cone-type connection means 144 (as shown in FIG. 4) and carrier 116. The cart body 102 is then rocked forward onto the balancing leg 112 and the stabilizing foot 166, bringing the wheels 114 off of the ground so that all of the weight is supported on a single point, the balancing leg 112 and the stabilizing foot 166. Noticing the relative position of the club head 108 to the ball, the player 160 will adjust as needed for proper contact position and the correct shaft angle to the ground. Player 160 gets better and quicker at this as they gain experience. Once the player has reached his desired position, he leans forward and places his lower rib cage on the body rest pad 104 and applies approx. 50% of his body weight down, straight through the cart body 102 to the balancing leg 112, anchoring it in position. The player's 160 two feet combined with the balancing leg 112 form a tripod base for stability. At this point the position of the cart body will be stable enough for the player 160 to move the handles 110, and therefore, the golf club 106, in a swinging arc motion. The player 160 can now perform a slow practice swing just as a golfer would draw their club back, then bring it back up to the ball, without hitting it. The final back swing would be up to 350 degrees to the 5 o'clock position (right-handed swing), depending on the amount of force the shot requires, before immediately pushing and pulling evenly with both hands on the handles 110. The handles are moved as forcefully as needed, while maintaining the position of the cart body 102

(a learned skill) in order to put the desired amount of power into the shot, taking care not to disturb the position or angle of the cart body 102.

The present invention provides the means to execute a perfectly arcing golf swing thus relieving player 160 of the need to adopt and practice that skill set. For many players and would-be players of the game of golf; the achievement of a consistent and competent golf swing presents the main barrier to entering and staying with the game of golf. The present apparatus 100 insures that a golf club 106 is swung in a perfect arc, thus relieving a player 160 of having to perform that portion of the golf game. However, the player 160 is still tasked with having to line up each shot by insuring that the golf club 106 is properly aligned, that an appropriate pitch is applied to the club face depending on factors such as distance to the hole, obstacles in the way and variations in the surface and texture of the course. Therefore, the invention presents the player an element of challenge and athleticism by being able to impart correct kinesthetic inputs to the invention as well as coordinating the actual swing of the golf club.

Figure 8:
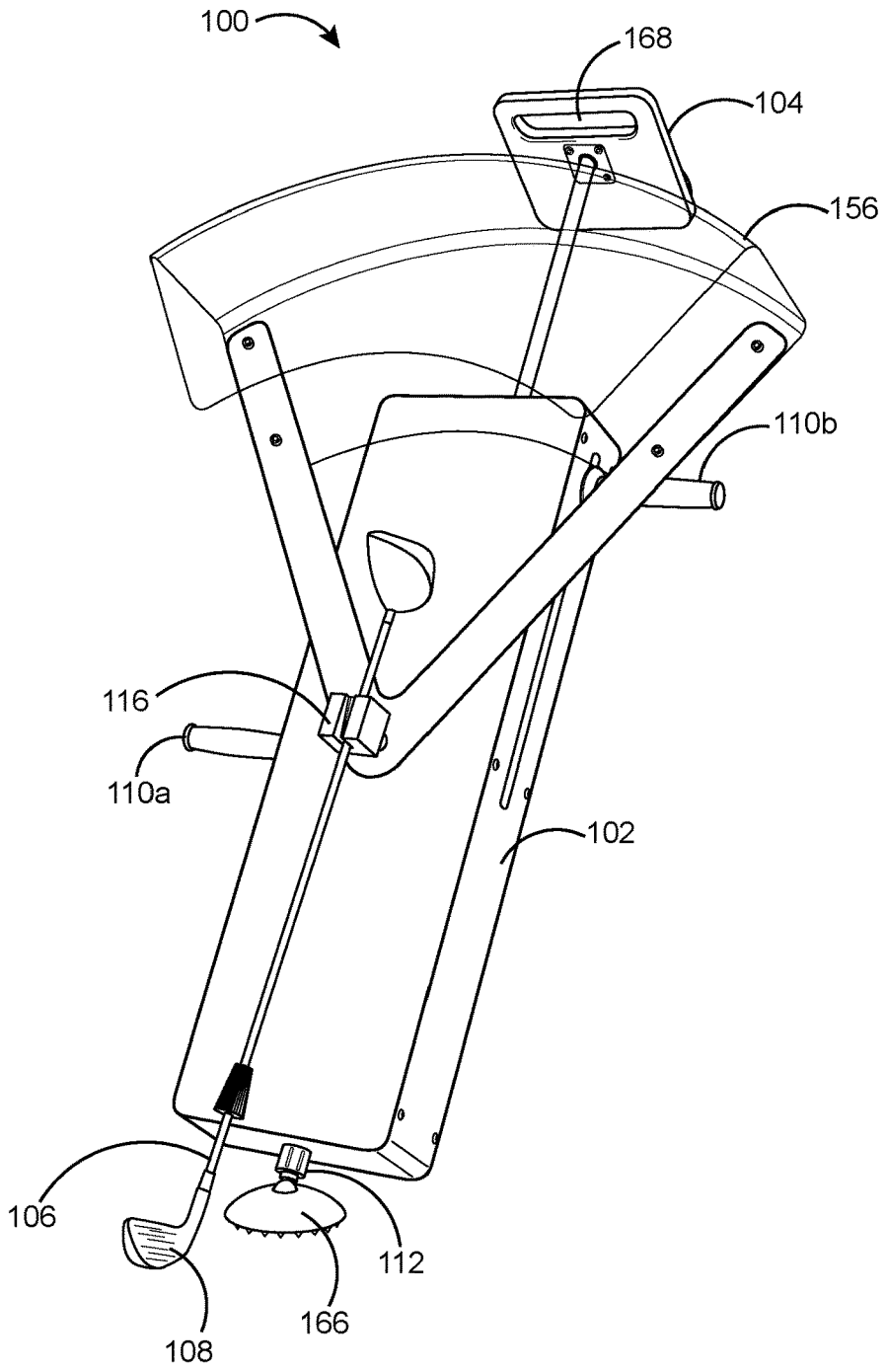
FIG. 8 illustrates a front perspective view of the golf swing apparatus without a pair of cart wheels in accordance with one embodiment of the present invention.

FIG. 8 illustrates a front perspective view of the golf swing apparatus without a pair of cart wheels in accordance with one embodiment of the present invention. The embodiment without the pair of wheels fixes to the ground by means of the stabilizing foot 166 and the balancing cart leg 112 allows the player to tilt the apparatus on any direction for perfectly arcing golf swing.

Figure 9:
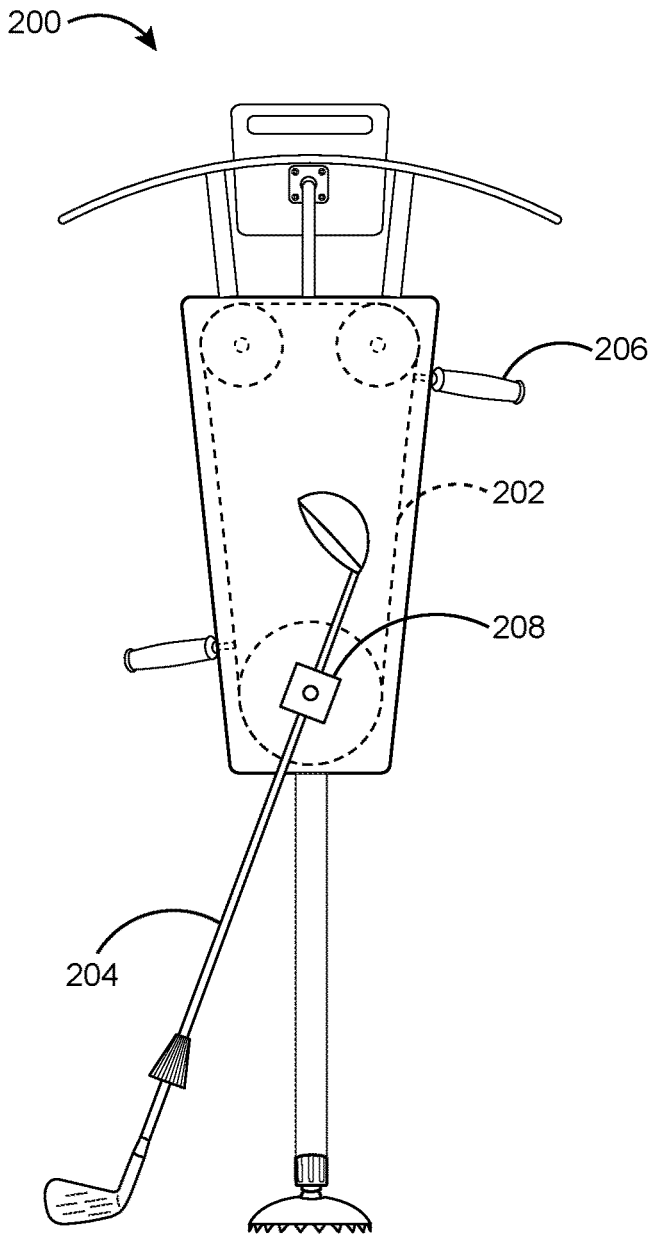
FIG. 9 is a schematic cross-sectional front view of the golf swing apparatus utilizing a serpentine belt in accordance with one embodiment of the present invention.

FIG. 9 is a schematic cross-sectional front view of the golf swing apparatus 200 utilizing a serpentine belt 202 in accordance with one embodiment of the present invention. In this embodiment the serpentine belt 202 is utilized to rotate the carrier 208 holding the golf club 204. The serpentine belt 202 is connected to the handle 206 of the apparatus 200. When a player pushes the handle 206, the serpentine belt 202 rotates the carrier 208 holding the golf club 204 to perfectly arc the golf swing that renders the player to line up a golf shot.

Figure 10:
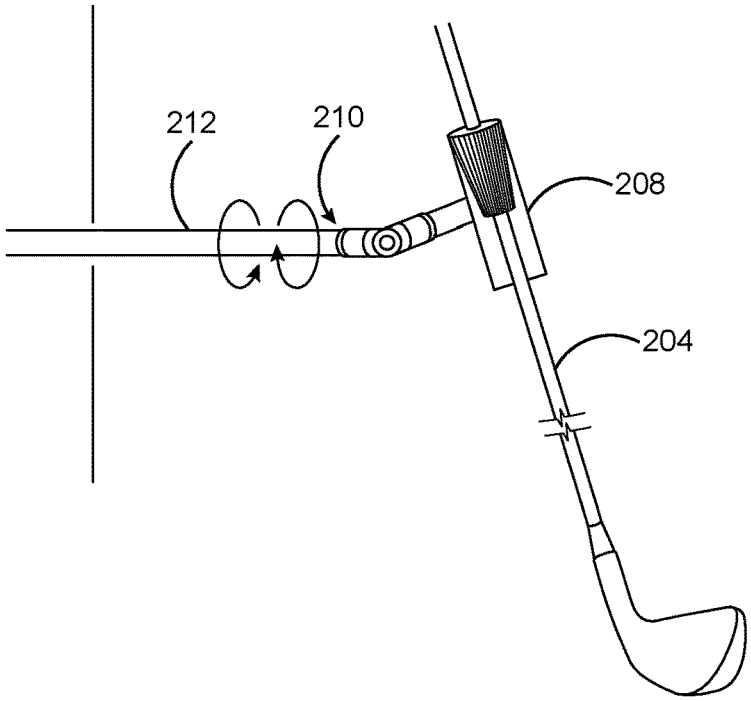
FIG. 10 illustrates a side view of the golf swing apparatus utilizing a universal joint in accordance with one embodiment of the present invention.

FIG. 10 illustrates a side view of the golf swing apparatus utilizing a universal joint 210 in accordance with one embodiment of the present invention. The universal joint 210 joins the drive shaft 212 of the apparatus with the carrier 208 holding the golf club 204. The universal joint 210 allows the player to predict where the club head would be during the swing. Also flex on the golf club 204 is minimized while using the universal joint 210.

Figure 11:
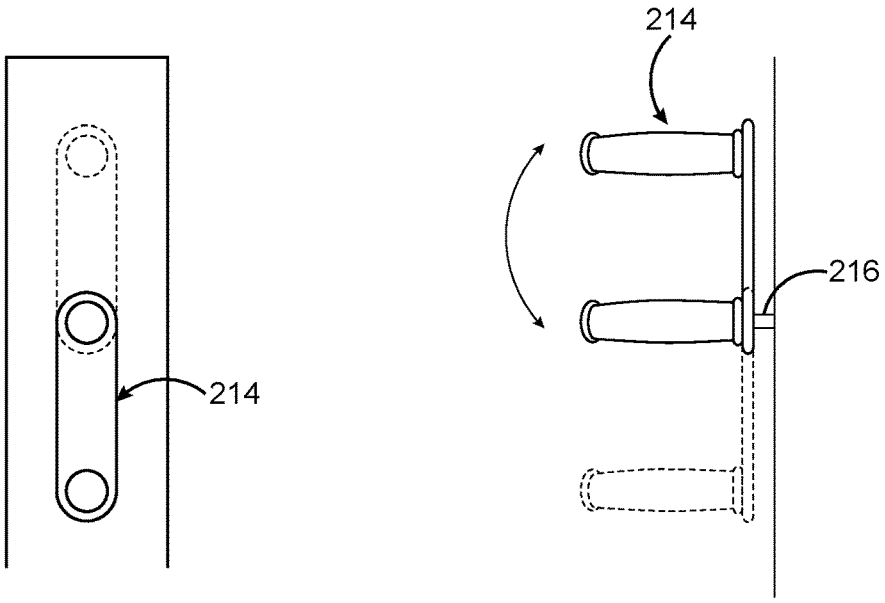
FIG. 11 illustrates a side view and a corresponding partial front view of the golf swing apparatus utilizing a two-position handle in accordance with one embodiment of the present invention.

FIG. 11 illustrates a side view and a corresponding partial front view of the golf swing apparatus utilizing a two-position handle 214 in accordance with one embodiment of the present invention. The two-position handle 214 allows the player to use the handle in two different positions. The two-position handle 214 has a pivot joint 216 which allows the player to pivot the handle 214 and use in either of the two positions. This embodiment of the apparatus is employed when the apparatus is being used on a slope.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. A golf swing assistance apparatus comprising: a cart body having a gear assembly enclosed therein; a height adjustable body rest pad attached to an upper end of the cart body; a pair of handle means movably attached to sides of the cart body and adaptable to actuate the gear assembly; a safety shroud attached to the cart body to ensure safety of a player; a carrier adaptable to hold at least one golf club, the carrier attached to the cart body; a drive shaft connected to the carrier and adaptable to engage with the gear assembly; and a balancing cart leg connected to a stabilizing foot, the balancing cart leg attached to a bottom portion of the cart body and configured to adjust a height of the golf swing assistance apparatus; whereby the player actuates the gear assembly by pressing the handle which rotates the drive shaft to create a direct drive mechanism that rotates the carrier and adjusts the at least one golf club in a perfect arc to hit a golf ball by providing a swing motion to the golf club.

2. The golf swing assistance apparatus of claim 1, wherein the gear assembly includes a main ring gear operably coupled to a drive shaft gear by means of a pawl.

3. The golf swing assistance apparatus of claim 2, wherein the drive shaft gear is attached to a drive shaft.

4. The golf swing assistance apparatus of claim 1, wherein a pair of cart wheels is attached to the bottom portion of the cart body extending outward and rearward from the side of the cart body.

5. The golf swing assistance apparatus of claim 1, wherein the golf club has a shaft length of 12 inches to 20 inches, measured from a center of cone-type connector to a bottom edge of the club head.

6. The golf swing assistance apparatus of claim 1, where in the height adjustable body rest pad on top of the cart body allows the player to rest his/her upper body there-upon.

7. The golf swing assistance apparatus of claim 1, wherein the balancing cart leg protrudes from the bottom of the cart body and is optionally retractable.

8. The golf swing assistance apparatus of claim 1, wherein the balancing cart leg allows the cart body to be lifted off of wheels of the cart body and balanced in conjunction with the player's body.

9. The golf swing assistance apparatus of claim 1, wherein the stabilizing foot is mounted to the cart leg to allow the cart body to be tilted in any direction in order to achieve proper alignment.

10. The golf swing assistance apparatus of claim 1, wherein the balancing leg provides a kinesthetic input to the player.

11. The golf swing assistance apparatus of claim 1, wherein the direct drive mechanism imparts a rotational energy to the golf club to swing in a perfect arc.

12. The golf swing assistance apparatus of claim 1, wherein the pair of handle means attached to a pair of slide assemblies so that the handles move up and down with the slide assemblies.

13. The golf swing assistance apparatus of claim 12, wherein the pair of slide assemblies are coupled with a pair of rack gears which engages with the main ring gear mounted on the drive shaft.

14. An apparatus for providing a competent and consistent golf swing that renders a player to lining up a golf shot, the apparatus comprising: a cart body having a gear assembly enclosed therein; a height adjustable body rest pad attached to an upper end of the cart body; a pair of handle means movably attached to sides of the cart body and adaptable to actuate the gear assembly; a safety shroud attached to the cart body to ensure safety of a player; a carrier adaptable to hold at least one golf club, the carrier attached to the cart body; a drive shaft connected to the carrier and adaptable to engage with the gear assembly; and a balancing cart leg connected to a stabilizing foot, the balancing cart leg attached to a bottom portion of the cart body and configured to adjust a height of a golf swing assistance apparatus; whereby the player actuates the gear assembly by a direct drive mechanism that adjusts the at least one golf club in a perfect arc to hit a golf ball by providing a swing motion to the golf club.

15. The apparatus of claim 14, wherein the gear assembly includes a main ring gear operably coupled to a drive shaft gear mounted on to a drive shaft.

16. The apparatus of claim 15, wherein the main ring gear engages the drive shaft gear which is fixed to the drive shaft by means of at least one pawl.

17. The apparatus of claim 14, wherein a pair of cart wheels is attached to the bottom portion of the cart body extending outward and rearward from the side of the cart body.

18. The apparatus of claim 14, wherein the balancing cart leg allows the player to control an amount of extension relative to a bottom portion of the cart body.

19. The apparatus of claim 14, wherein the golf club has a shaft length of about 12 inches to 20 inches.

20. The apparatus of claim 14, wherein the height adjustable body rest pad on top of the cart body allows a player to rest his/her upper body there-upon.

21. The apparatus of claim 14, wherein the direct drive mechanism imparts a rotational energy to the golf club that enables the golf club to swing in a perfect arc.

22. The apparatus of claim 14 further comprises a pair of slide assemblies movably attached to the pair of handle means.

23. The apparatus of claim 22, wherein the slide assemblies are coupled with a pair of rack gears that engages with the main ring gear.

24. The apparatus of claim 14, wherein the pair of handle means move up and down with slide assemblies when the player actuates the handles.

25. The apparatus of claim 14, wherein a main ring gear, in conjunction with a drive shaft gear and the drive shaft ensures a perfect arc for the golf club to bring the club head into contact with the ball to achieve a good shot.

26. An apparatus for providing a competent and consistent golf swing that renders a player to lining up a golf shot utilizing a dual-headed golf club, the dual-headed golf club being mounted in a carrier assembly and rotatably attached to a drive shaft, the apparatus comprising: a cart body having a gear assembly enclosed therein, the gear assembly includes a main ring gear operably coupled to a drive shaft gear by means of a pawl, the drive shaft gear attached to a drive shaft; a height adjustable body rest pad attached to an upper end of the cart body; a pair of handle means movably attached to sides of the cart body, the pair of handles attached to a slide assembly connected to a rack gear, the rack gear adaptable to actuate the main gear attached to the drive shaft; a safety shroud attached to the cart body to ensure safety of a player; a carrier positioned on the cart body and configured to hold at least one golf club, the carrier attached to the drive shaft and actuated by the gear assembly; and a balancing cart leg connected to a stabilizing foot, the balancing cart leg attached to a bottom portion of the cart body and configured to adjust a height of a golf swing assistance apparatus; whereby the player actuates the gear assembly by pressing the handle which rotates the drive shaft and the carrier to adjusts the at least one golf club in a perfect arc to hit a golf ball.

27. The apparatus of claim 26, wherein the golf club has a shaft length of 12 inches to 20 inches.

28. The apparatus of claim 26, wherein a pair of cart wheels is attached to the bottom portion of the cart body extending outward and rearward from the side of the cart body.

29. The apparatus of claim 26, wherein the balancing cart leg allows the player to control an amount of extension relative to the bottom portion of the cart body.

30. The apparatus of claim 26, wherein the height adjustable body rest pad is made possible by a male support member and insertable into a larger diameter female support channel member.

31. The apparatus of claim 26, wherein the gear assembly is a mechanical gear array which is actuated by the player.

32. The apparatus of claim 26, wherein the pair of handle means actuates the gear assembly that is attached to the slide assembly.

33. The apparatus of claim 26, wherein the pair of handle means move up and down with slide assemblies.

34. The apparatus of claim 26, wherein the rack gear engages with the main ring gear and allows the slide assembly to move up and down.

35. The apparatus of claim 26, wherein the main ring gear is attached to at least one pawl.

* * * * *